US009738429B2

(12) United States Patent
Buelna

(10) Patent No.: US 9,738,429 B2
(45) Date of Patent: Aug. 22, 2017

(54) SUPPORT ASSEMBLY FOR SUSPENSION OF CARGO DURING TRANSPORT

(71) Applicant: fringenius, San Jose, CA (US)

(72) Inventor: Ed Buelna, San Jose, CA (US)

(73) Assignee: FRINGENIUS, San Jose, CA (US)

( * ) Notice: Subject to any disclaimer, the term of this patent is extended or adjusted under 35 U.S.C. 154(b) by 0 days.

(21) Appl. No.: 14/936,547

(22) Filed: Nov. 9, 2015

(65) Prior Publication Data

US 2016/0137384 A1 May 19, 2016

Related U.S. Application Data

(60) Provisional application No. 62/079,526, filed on Nov. 13, 2014.

(51) Int. Cl.
*B65D 81/07* (2006.01)

(52) U.S. Cl.
CPC ..... *B65D 81/07* (2013.01)

(58) Field of Classification Search
CPC ..... B65D 25/10; B65D 29/04; B65D 33/14; B65D 81/07; B65D 81/075; F16M 13/02; F16M 13/027
USPC ..... 206/583; 248/610–612
See application file for complete search history.

(56) References Cited

U.S. PATENT DOCUMENTS

| | | | | | |
|---|---|---|---|---|---|
| 2,653,709 | A * | 9/1953 | Cunningham | B65D 81/07 | 206/583 |
| 2,696,322 | A * | 12/1954 | Densen | B65D 81/07 | 206/583 |
| 4,013,170 | A * | 3/1977 | Hutterer | B65D 81/07 | 206/583 |
| 5,823,348 | A * | 10/1998 | Phillips | B65D 81/07 | 206/583 |
| 6,158,589 | A * | 12/2000 | Smith | B65D 81/07 | 206/583 |
| 7,516,597 | B1 * | 4/2009 | Roose | B65B 55/20 | 53/139.5 |
| 2013/0233757 | A1 * | 9/2013 | Fileni | B65D 81/075 | 206/583 |
| 2015/0266646 | A1 * | 9/2015 | Feng | B65D 81/075 | 206/583 |

FOREIGN PATENT DOCUMENTS

| | | | | |
|---|---|---|---|---|
| GB | 290817 A * | 5/1928 | ..... | B65D 81/07 |
| JP | 2000327040 A * | 11/2000 | ..... | B65D 81/07 |

* cited by examiner

*Primary Examiner* — Bryon Gehman

(57) ABSTRACT

A support assembly can provide support for an object suspended within an exterior container by wrapping around the object in attaching to opposite inner surfaces of the exterior container. To support the object, a first attachment member can be attached to a first side of the exterior housing, and a body can wrap entirely about a perimeter of the object. At least a portion of the support assembly can extend through an opening of the body at least partially overlap itself. Beyond the region of the overlap, a second attachment member can be attached to a second side of the exterior housing.

14 Claims, 4 Drawing Sheets

SUPPORT ASSEMBLY FOR SUSPENSION OF CARGO DURING TRANSPORT

RELATED U.S. APPLICATIONS

This application claims the benefit of and priority to the copending provisional patent application, Ser. No. 62/079,526, entitled "SUPPORT ASSEMBLY FOR SUSPENSION OF CARGO DURING TRANSPORT," with filing date Nov. 13, 2014, and hereby incorporated by reference in its entirety.

FIELD

The subject technology relates to support assemblies for protecting objects within an exterior container.

BACKGROUND

Costly, fragile, volatile, dangerous, and hazardous objects which are trucked, shipped, or mailed over distances are often subject to rough handling which may include dropping, kicking, tossing, general mishandling by persons, or numerous other abuses. These incidents typically occur when the objects are no longer under the control of the person who packaged them.

Various methods and apparatuses for protecting delicate, valuable, and breakable objects are generally known. These are traditionally referred to as packaging materials. These packaging materials often take the form of bubble-wrap, foam peanuts, blocks, and/or foam padding. Traditionally, for example, an extremely fragile item which is desired to be shipped to a remote location will be "double-boxed". This means the object itself is padded and snugly packaged inside an inner box. The inner box is then in tum wrapped snugly with additional packing material, and thereafter stuffed into a larger outer box. With double-boxing, the fragile objects receive improved protection from crushing forces, but remain vulnerable to damage due to shock forces which are experienced by the package. If the package is dropped during transit, the object's internal structure may be damaged through the sudden deceleration which is well known and understood as a shock force.

Since conventional packaging materials and methods often fail to prevent damage to shipped objects which result from a shock force, there is thus a present need for a method and apparatus which greatly reduces the likelihood of damage occurring to shipped objects.

SUMMARY

The subject technology is illustrated, for example, according to various aspects described below. Various examples of aspects of the subject technology are described as numbered clauses (1, 2, 3,etc.) for convenience. These are provided as examples and do not limit the subject technology. It is noted that any of the dependent clauses may be combined in any combination, and placed into a respective independent clause, e.g., clause 1 or clause 10. The other clauses can be presented in a similar manner.

An embodiment is directed to a support assembly comprising a first attachment member at a first end region of the support assembly and a second attachment member at a second end region of the support assembly. The support assembly further comprises a main body having an opening and a neck between the second end region and the main body. The neck providing (i) a plurality of peaks having a peak cross-sectional dimension that is greater than an opening cross-sectional dimension of the opening and (ii) a plurality of troughs, each of the troughs being between pairs of the plurality of peaks and having a trough cross-sectional dimension that is less than the opening cross-sectional dimension. In some embodiments, the first attachment member comprises first and second arms, the opening being formed between the first and second arms. In some embodiments, the first attachment member and the second attachment member each comprise an adhesive.

In some embodiments, the support assembly further comprises a third attachment member between the first end region and a second end region and extending from the main body. In some embodiments, the third attachment member comprises an adhesive. In some embodiments, the support assembly further comprises a plurality of apertures extending through the main body. In some embodiments, the support assembly is bilaterally symmetric. In some embodiments, the main body has a maximum width that is greater than a maximum width of the neck. In some embodiments, in a flat configuration, the support assembly provides a substantially uniform thickness between the first attachment member and the second attachment member.

Another embodiment is directed to support assembly comprising a first attachment member attached to a first side of an exterior container and a main body extending at least partially along a bottom surface of an object and having an opening. The support assembly further comprises a neck having (i) a first segment extending at least partially along a top surface of the object, (ii) an engagement section extending through the opening, and (iii) a second segment extending along the bottom surface and overlapping at least a portion of the main body. The support assembly further comprises a second attachment member attached to a second side of the exterior container.

In some embodiments, the first attachment member comprises first and second arms, wherein the first attachment member is attached to the first side by the first and second arms, wherein the opening is formed between the first and second arms. In some embodiments, the main body is between the first attachment member and the neck. In some embodiments, the neck is between the main body and the second attachment member. In some embodiments, the engagement section is between the first segment and the second segment. In some embodiments, the first side is substantially opposite the second side. In some embodiments, the third side is substantially between the first side and the second side.

In some embodiments, the engagement section provides (i) a plurality of peaks having a peak cross-sectional dimension that is greater than an opening cross-sectional dimension of the opening and (ii) a plurality of troughs, each of the troughs being between pairs of the plurality of peaks and having a trough cross-sectional dimension that is less than the opening cross-sectional dimension. In some embodiments, in a flat configuration, the support assembly provides a substantially uniform thickness between the first attachment member and the second attachment member.

Another embodiment is directed to a method comprising providing a support assembly with a first attachment member attached to a first side of an exterior container and applying a main body of the support assembly at least partially along a bottom surface of an object. The method further comprises applying a first segment of the support assembly at least partially along a top surface of the object and inserting an engagement section of the support assembly through an opening of the main body.

The method further comprise applying a second segment of the support assembly at least partially along the bottom surface and overlapping at least a portion of the main body and attaching a second attachment member of the support assembly to a second side of the exterior container. In some embodiments, the method further comprises attaching a third attachment member, extending from the main body, to a third side of the exterior container. In some embodiments, the first attachment member is attached to the first side by first and second arms, the opening being defined between the first and second arms.

Another embodiment is directed to a support assembly comprising a first attachment member attached to a first side of an exterior container and a body that wraps entirely about a perimeter of an object, extends through an opening of the body, and at least partially overlaps itself. The support assembly further comprises a second attachment member attached to a second side of the exterior container.

Another embodiment is directed to a method comprising providing a support assembly with a first attachment member attached to a first side of an exterior container and wrapping a body of the support assembly entirely about a perimeter of an object, a portion of the support assembly extending through an opening of the support assembly, with the support assembly overlapping itself. The method further comprises attaching a second attachment member of the support assembly to a second side of the exterior container.

Additional features and advantages of the subject technology will be set forth in the description below, and in part will be apparent from the description, or may be learned by practice of the subject technology. The advantages of the subject technology will be realized and attained by the structure particularly pointed out in the written description and claims hereof as well as the appended drawings.

It is to be understood that both the foregoing general description and the following detailed description are exemplary and explanatory and are intended to provide further explanation of the subject technology as claimed.

BRIEF DESCRIPTION OF THE DRAWINGS

The accompanying drawings, which are included to provide further understanding of the subject technology and are incorporated in and constitute a part of this description, illustrate aspects of the subject technology and, together with the specification, serve to explain principles of the subject technology.

DETAILED DESCRIPTION

Figure 1:
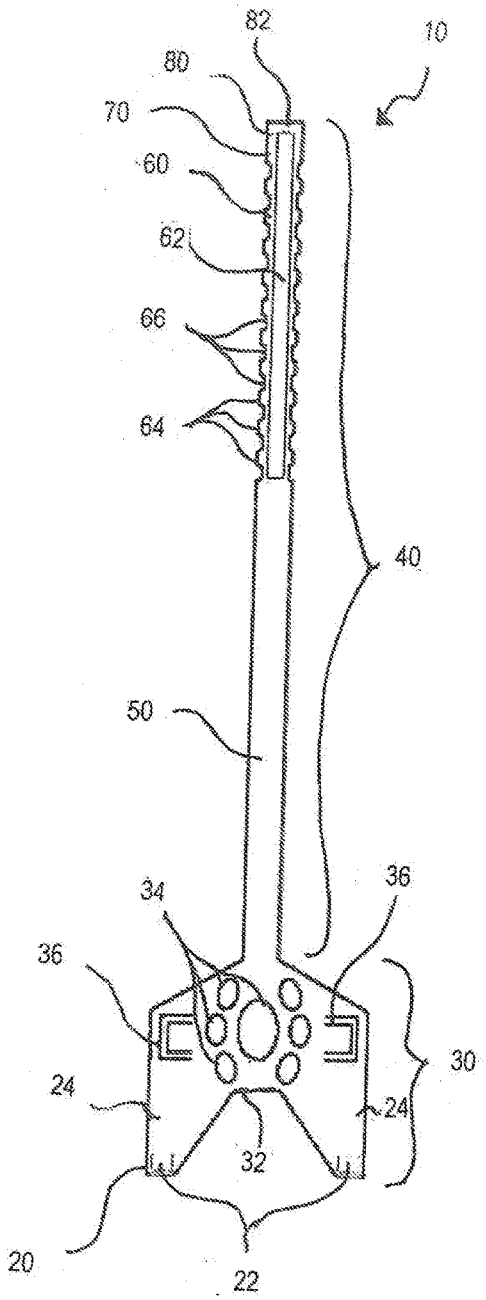
FIG. 1 shows a view of an exemplary support assembly in a flat configuration.

In the following detailed description, specific details are set forth to provide an understanding of the subject technology. It will be apparent, however, to one ordinarily skilled in the art that the subject technology may be practiced without some of these specific details. In other instances, well-known structures and techniques have not been shown in detail so as not to obscure the subject technology.

A phrase such as "an aspect" does not imply that such aspect is essential to the subject technology or that such aspect applies to all configurations of the subject technology. A disclosure relating to an aspect may apply to all configurations, or one or more configurations. An aspect may provide one or more examples of the disclosure. A phrase such as "an aspect" may refer to one or more aspects and vice versa. A phrase such as "an embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples of the disclosure. A phrase such "an embodiment" may refer to one or more embodiments and vice versa. A phrase such as "a configuration" does not imply that such configuration is essential to the subject technology or that such configuration applies to all configurations of the subject technology. A disclosure relating to a configuration may apply to all configurations, or one or more configurations. A configuration may provide one or more examples of the disclosure. A phrase such as "a configuration" may refer to one or more configurations and vice versa.

The subject technology relates to support assemblies for protecting objects within an exterior container. The support assemblies may suspend the object within the exterior container such that the object has no direct contact with the exterior container. Such suspension provides protection of the object from the effects of shock and impact applied to the exterior container. The support assembly can be provided as an integral portion of the exterior container or as an insert to be installed along with packing of the object. The support assembly can be formed as a unitary or modular piece. Such support assemblies can be adjusted to accommodate a wide variety of objects. Support assemblies can further provide adjustable features to fit any given support assembly to a wide variety of objects. Support assemblies can be quickly and easily assembled to suspend the object. Furthermore, support assemblies can be produced efficiently and inexpensively.

According to some embodiments, a support assembly 10 can be provided to suspend and support an object 200 within an exterior container 110. The support assembly 10 can include at least one first attachment members 22 on a first end section 20 of the support assembly 10. More than one first attachment members 22 can be provided for attachment to an exterior container 110. Each of the first attachment members 22 can be provided on a respective arm 24 of the first end 20. According to some embodiments, the first attachment members 22 may include an adhesive or other mechanism for accomplishing attachment to a first surface 120 of the exterior container 110. For example, the first attachment members 22 can include an adhesive, Velcro, fasteners, latching members, or other mechanical or chemical mechanism to engage the exterior container 110. Alternatively, the first attachment members 22 can be integrally and monolithically formed with the exterior container 110.

According to some embodiments, the support assembly 10 can be formed (e.g., die cut) from a single, continuous piece of material and folded to form a support for the object 200. According to some embodiments, the support assembly 10 and the exterior container 110 can be formed (e.g., die cut) from a single, continuous piece of material and folded to form a support for the object 200. According to some embodiments, the support assembly 10 and/or the exterior container 110 can be formed of one or more materials, including corrugated fiberboard, paper, paperboard, plastics, rubber, fiber, foil, cloth, foam, sheet metal, and combinations thereof.

A main body 30 can be provided adjacent to or including the first attachment members 22. The main body 30 can be any size and shape configured to fit within the exterior container 110 and about at least a portion of the object 200.

Figure 2:
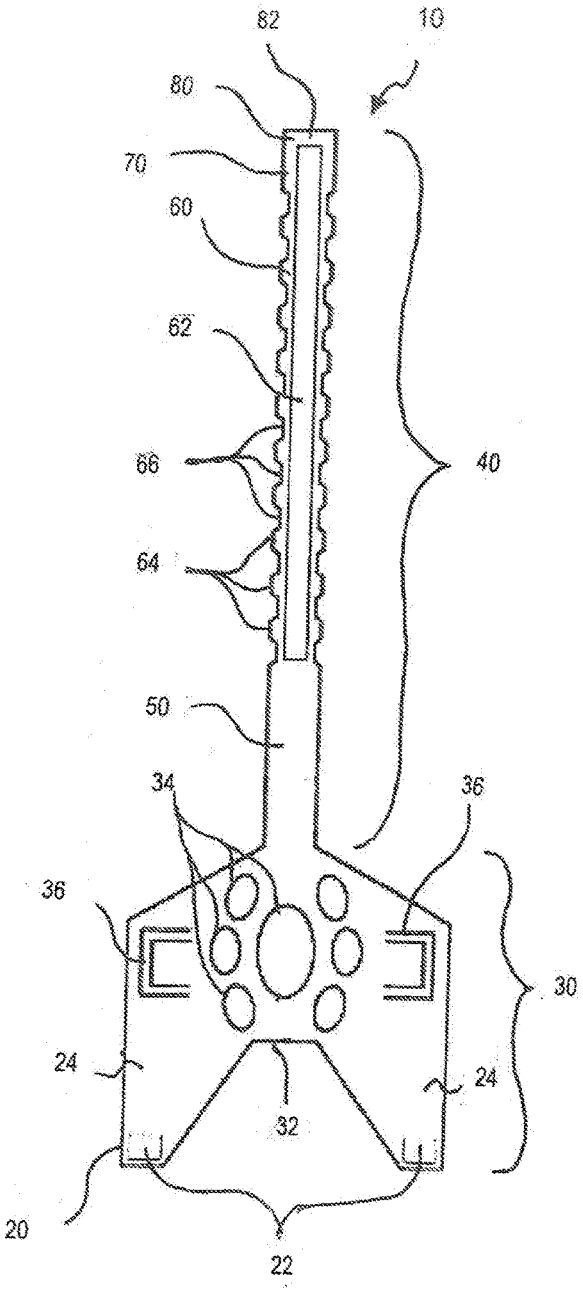
FIG. 2 shows a view of an exemplary support assembly in a flat configuration.

According to some embodiments, the main body 30 includes an opening 32 extending entirely through the main body 30. According to some embodiments, the opening 32 can be formed as an open space between two or more arms 24 of the first end section 20. The opening 32 can have a complete boundary or be unbounded, as shown in FIGS. 1 and 2. The opening 32 can be of a size and shape that is configured to engage an engagement section 60 of a neck 40, as discussed further herein. For example, the arms 24 extending from a terminal end of the end section 20 can be joined at an edge forming the least a portion of the opening 32. The distance between the arms 24 at such an edge can define the width of the opening 32. By further example, the opening 32 may be any shape, including a circle, oval, rectangle, polygon, or any other shape. According to some embodiments, the opening 32 can have a longitudinal length that is significantly smaller than the width thereof. For example, the opening 32 can form a narrow slot to receive an engagement section 60 of the neck 40.

According to some embodiments, as shown in FIG. 2, flexible regions 26 can be provided along or near the arms 24. Alternatively or in combination, flexible regions 26 can be provided along any portion of the support assembly 10 (e.g., the main body 30 and/ or the neck 40). The flexible regions 26 can include any structure and/or configuration that provides preferential folding along a length thereof. For example, the flexible regions 26 can include perforation, a pre-fold, and/or a region of thinner material. A plurality of flexible regions 26 can be provided for a user to select one or more of the flexible regions 26 for preferential sizing to accommodate a given object 200. As shown in FIG. 2, the flexible regions 26 can be oriented orthogonally relative to a longitudinal axis of the support assembly 10. By further example, flexible regions 26 can have any orientation or direction along a length of the support assembly 10.

According to some embodiments, a plurality of apertures 34 can be provided extending entirely through distinct portions of the main body 30. For example, as shown in FIGS. 1 and 2, the apertures 34 may be distributed to provide programmed flexibility to the main body 30. The apertures 34 provide the main body 30 with greater flexibility to surround at least a bottom surface of the object 200. For example, where the object 200 is curved, the apertures 34 can allow portions of the main body 30 to cradle that object 200 as it wraps at least partially along the sides of the object 200. As will be appreciated, anyone or more of a variety of designs for apertures 34 can provide a desired flexibility and shape to the main body 31 engaging the object 200. For example, the apertures 34 can include narrow slots, zigzag patterns, or ovals (as shown in FIGS. 1 and 2). As shown in FIGS. 1 and 2, a central aperture 34 can be provided with additional apertures 34 surrounding the central aperture 34. Alternatively, the main body 30 may provide no aperture 34, and thereby may provide a continuous, uninterrupted surface along the length thereof.

According to some embodiments, the main body 30 can include one or more lateral attachment members 36. The lateral attachment members 36 can extend from a portion of the main body 30 to engage a portion of the exterior container 110. For example, the lateral attachment members 36 can be attached to the main body 30 at one or more locations and have a size and shape that allows a portion thereof to reach a bottom surface 140 of the exterior container 110 and engage thereto. The lateral attachment members 36 can include an adhesive or other mechanism for attaching to a portion of the exterior container 110. According to some embodiments, the lateral attachment members 36 can provide columnar support for the object 200 relative to the bottom surface of the exterior container 110. For example, the lateral attachment members 36 can be of a rigid or somewhat rigid material capable of bearing a weight of the object 200 in support thereof by resisting compressive forces applied to the lateral attachment members 36. According to some embodiments, the lateral attachment members 36 can provide suspension of the object 200 relative to the bottom surface 140 of the exterior container 110 when under tension. For example, a force drawing the object 200 away from the bottom surface 140 of the exterior container 110 can cause the object 200 to tend to move away from the bottom surface 140. The lateral attachment members 36 can limit movement of the object 200 away from the bottom surface 140 by maintaining an attachment to the bottom surface 140 while resisting tension applied to the lateral attachment members 36. The lateral attachment members 36 can further provide protection to the object 200 by absorbing shock and impact applied to the external container 110. The lateral attachment members 36 can bend, flex, and stretch to provide shock absorption.

According to some embodiments, the main body 30 can be disposed between the first end section 20 and a second end section 80 of the support assembly 10. According to some embodiments, the main body 30 can be disposed between the first end section 20 and a neck 40 of the support assembly 10.

According to some embodiments, the neck 40 of the support assembly 10 can extend between the main body 30 and the second end section 80. According to some embodiments, the neck 40, or portions thereof, may have a width, transverse to a longitudinal axis of the support assembly 10, that is less than at least a portion of the main body 30. The greater width of the main body 30 can transition to a lesser width of the neck 40 by a tapered, curved, or other transitional shape.

According to some embodiments, the neck 40 can include a first segment 50, an engagement section 60, and the second segment 70. The first segment 50 can be disposed between the engagement section 60 and the main body 30. The engagement section 60 can be disposed between the first section 50 and the second segment 70. The second segment 70 can be disposed between the engagement section 60 and the second end section 80. According to some embodiments, each of the first segment 50, the engagement section 60, and the second segment 70 can include a length and width that corresponds to desired characteristics thereof. For example, the length and width of the neck 40 can be selected to accommodate the size, shape, and weight of the object 200. For example, as shown in FIGS. 1 and 2, different lengths and widths for each of the first segment 50, the engagement section 60, and the second segment 70 can be selected to accommodate different types of objects 200.

According to some embodiments, the engagement section 60 can include a plurality of peaks 64 and a plurality of troughs 66. Each of the peaks 64 can be located between longitudinal adjacent pairs of troughs 66. Each of the troughs 66 can be located between longitudinal adjacent pairs of the peaks 64. The width of the peaks 64 can be greater than a width of the troughs 66, such that the engagement section 60 can settle within the opening 32 with the troughs 66 contacting edges of the openings 32. Likewise, at least some of the peaks 64 can be located on a first side of the opening 32 and a remainder of the peaks 64 can be located on an opposite side of the opening 32. The peaks 64 and the troughs 66 can be defined by any quantity, size, shape or other feature that is configured to engage within the opening 32. For example, the combination of peaks 64 and troughs 66 can form a sinusoidal pattern, square waves Pattern, sawtooth pattern, or other pattern. The number and length of peaks 64 and troughs 66 can provide variable adjustment of the support assembly 10 about the object 200. Accordingly, the support assembly 10 can be secured to a variety of objects 200 having one of a variety of sizes and shapes. According to some embodiments, an attachment surface 62 (e.g., adhesive) can extend longitudinally between at least two adjacent sides of the engagement section 60. The attachment surface 62 can be of any length, width, or shape that provides an ability to attach and adhere the neck 40 to another portion of the support assembly 10, the object 200, and/or the exterior container 110. The attachment surface 62 can include an adhesive, Velcro, fasteners, latching members, or other mechanical or chemical mechanism to engage another portion of the support assembly 10.

According to some embodiments, the support assembly 10 can provide second attachment members 82 at a second end region 80 of the support assembly 10. According to some embodiments, the second attachment members 82 may include an adhesive or other mechanism for accomplishing attachment to a second surface 130 of the exterior container 110. For example, the second attachment members 82 can include an adhesive, Velcro, fasteners, latching members, or other mechanical or chemical mechanism to engage the exterior container 110. Alternatively, the second attachment members 82 can be integrally and monolithically formed with the exterior container 110.

Figure 3A:
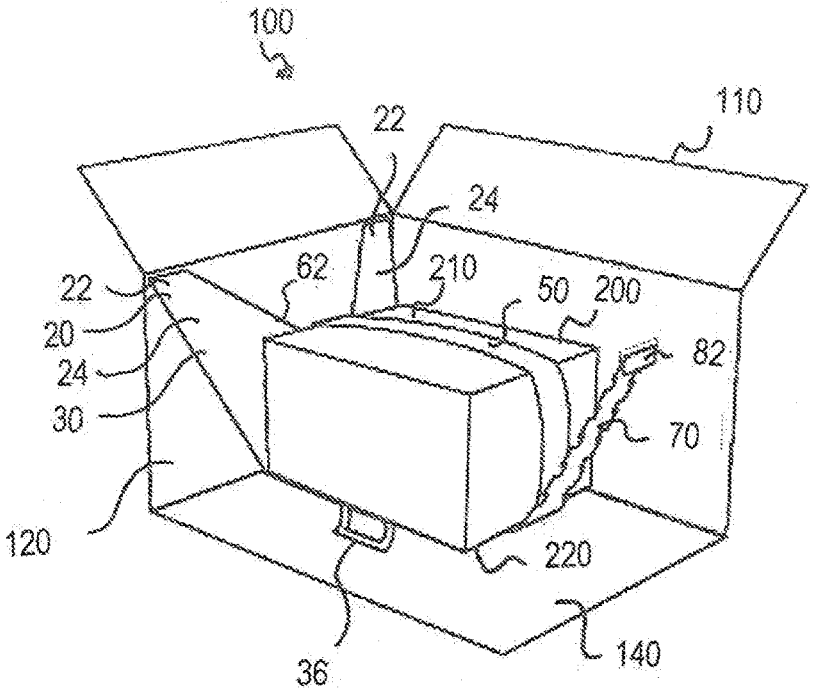
FIGS. 3A, 3B, and 3C show partial cutaway views of an exemplary support assembly suspending an object within an exterior container.
Figure 3B:
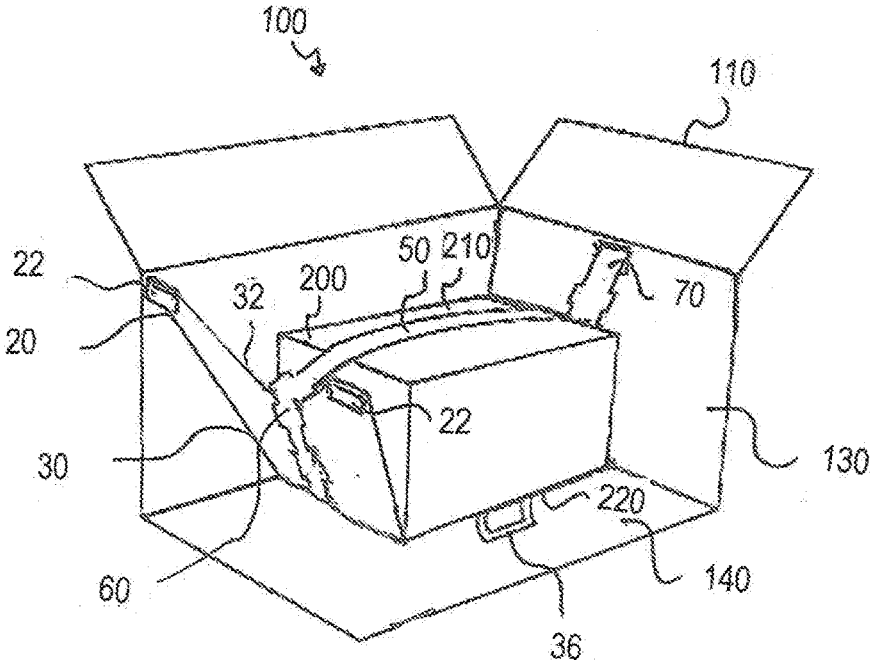
Figure 3C:
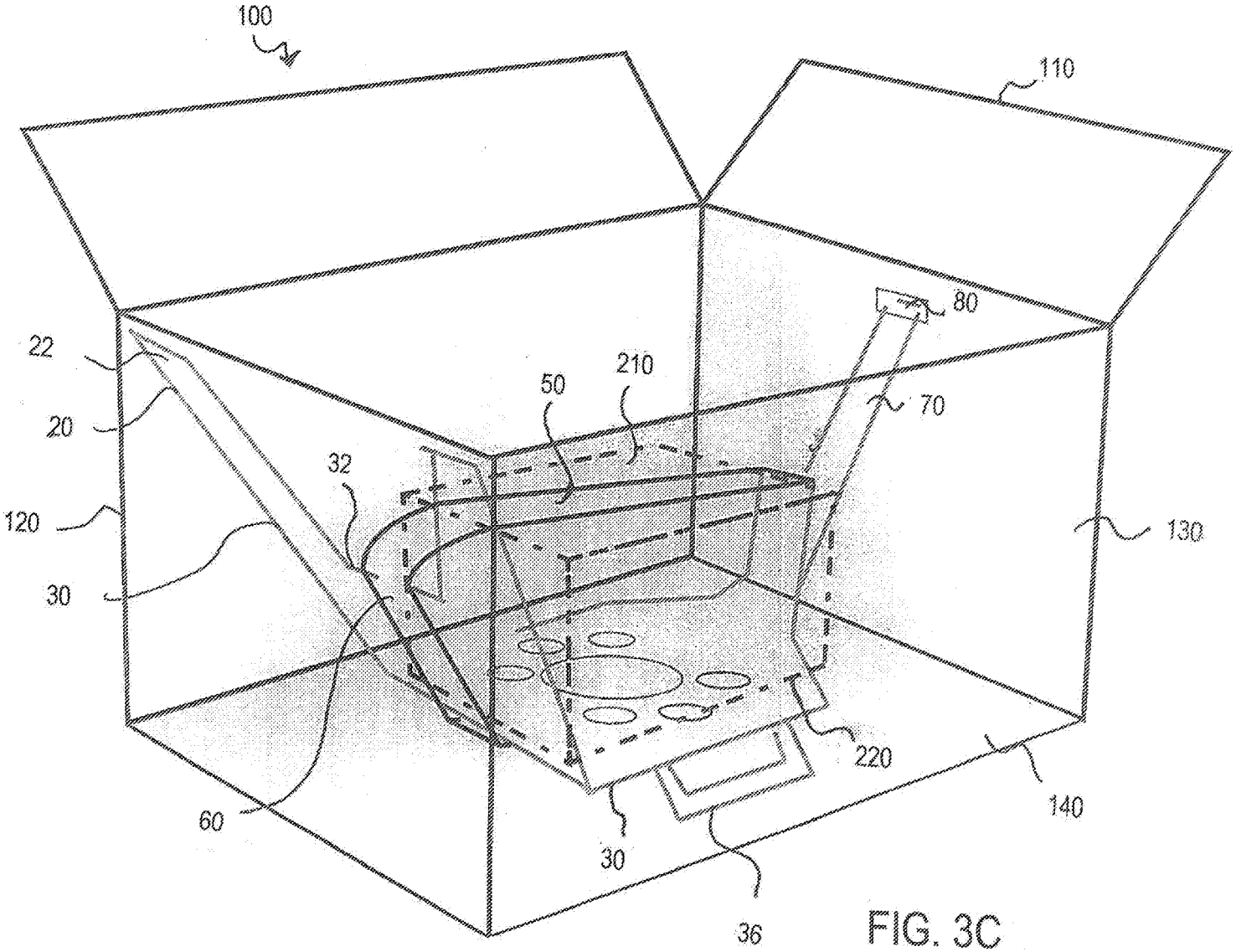

According to some embodiments, as shown in FIGS. 3A-3D, the support assembly 10 can support the object 200 by attaching the one or more first attachment members 22 to the first surface 120 of the exterior container 110. The main body 30 can wrap under and partially or entirely about a perimeter of the object 200. The first section 50 can extend along and contact a top side 210 (and/or adjacent sides) of the object 200. The neck 40 of the support assembly 10 can extend between the arms 24 and through the opening 32. As shown in FIG. 3B, the peaks 64 and troughs 66 of the engagement section 60 can facilitate engagement with the opening 32 (e.g., by contacting the arms 24 on either side of the opening 32).

Extending past the opening 32, a portion of the support assembly 10 (e.g., the second segment 70) at least partially overlaps another portion of the support assembly 10 (e.g., the main body 30). A region of overlap can include portions of the support assembly 10 along the bottom side 220. According to some embodiments, along the region of overlap, the adhesive surface 62 extending along at least a portion of the neck 40 can adhere to another portion of the support assembly 10 (e.g., the main body 30 and/or the first segment 50). Beyond the region of overlap, the second segment 70 and/or the second end section 20 can extend to attach one or more second attachment members 82 to the second surface 130.

The resultant position and orientation of the object 200 within the exterior container 110 can be determined based on assembly and an adjustment of the support assembly 10. For example, a position of the object 200 between the first and second surfaces 120, 130 of the exterior container 110 can be determined at least in part by placement of the object 200 along the length of the support assembly 10 (e.g., along the main body 30). Accordingly, the clearance between the object 200 and the first and second surfaces 120, 130 can be determined in this manner. By further example, a position of the object 200 between the bottom surface 140 and an opposing top surface (not shown) can be determined at least in part by the location on the first surface 120 to which the first end 20 is attached and/or the location on the second surface 130 to which the second end 30 is attached.

Figure 4:
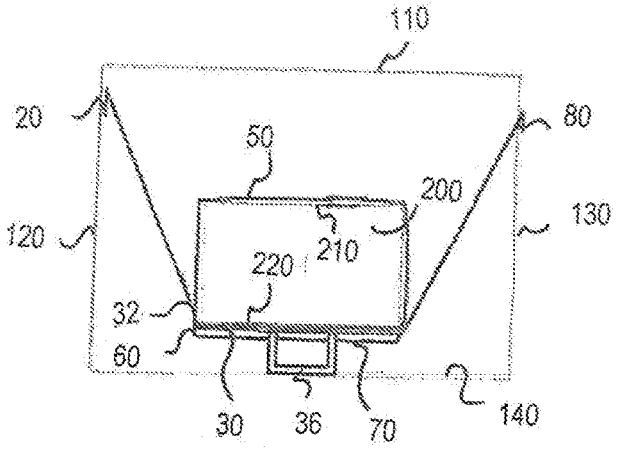
FIG. 4 shows a partial sectional view of an exemplary support assembly suspending an object within an exterior container.
Figure 3D:
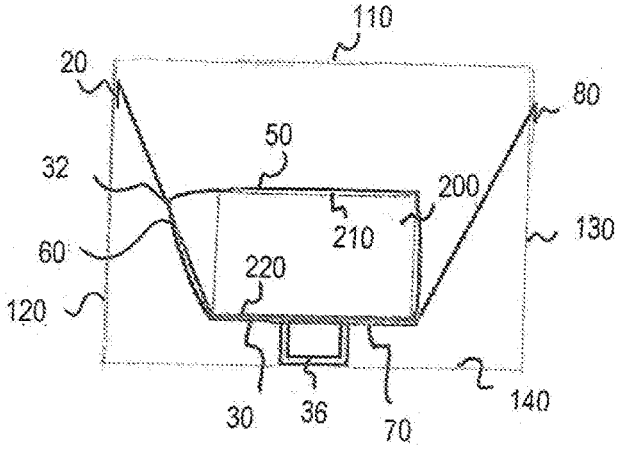
FIG. 3D shows a partial sectional view of an exemplary support assembly suspending an object within an exterior container.

According to some embodiments, as shown in FIG. 4, the support assembly 10 can support the object 200 by attaching the one or more first attachment members 22 to the first surface 120 of the exterior container 110, with the main body 30 wrapping under and partially or entirely about a perimeter of the object 200, as described above. As further shown in FIG. 4, the first section 50 can extend toward the first surface 120, and downward toward the bottom surface 140. In such a position, the first section 50 can remain substantially flush against a vertical side of the object 200. The engagement section 60 can pass through the opening 32, and a portion of the support assembly 10 (e.g., the second segment 70) at least partially overlaps another portion of the support assembly 10 (e.g., the main body 30). As shown in FIG. 4, this configuration allows all sides about a perimeter of the object 200 to be contacted by the support assembly 10. Such contact can provide a more secure engagement between the support assembly 10 and the object 200.

Figure 5:
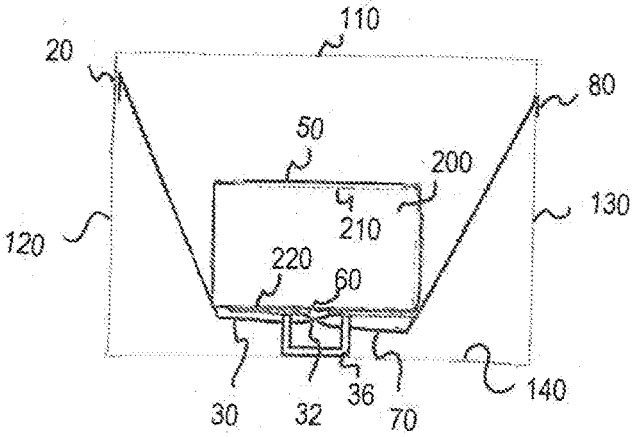
FIG. 5 shows a partial sectional view of an exemplary support assembly suspending an object within an exterior container.

According to some embodiments, as shown in FIG. 5, the support assembly 10 can support the object 200 by attaching the one or more first attachment members 22 to the first surface 120 of the exterior container 110, with the main body 30 wrapping under and partially or entirely about a perimeter of the object 200, as described above. As further shown in FIG. 5, the first section 50 can extend toward the first surface 120, and downward toward the bottom surface 140. In such a position, the first section 50 can remain substantially flush against a vertical side of the object 200. The engagement section 60 can also remain flush against a bottom side 220 of the object 200 before passing through the opening 32. On one side of the opening 32, the engagement section 60 is flush against the object 200 and the main body 30 overlies the engagement section 60. On the other side of the opening 32, the main body 30 is flush against the object 200 and the engagement section 60 overlies the main body 30. As shown in FIG. 5, this configuration allows all sides about a perimeter of the object 200 to be contacted by the support assembly 10. Furthermore, the opening 32 can provide lateral support for the engagement section 60, which may help maintain both the main body 30 and the neck 40 in a stationary position. For example, the first and second arms 24 can surround the engagement section 60 to guide and maintain the engagement section 60 in an overlapping position.

According to some embodiments, as shown in FIGS. 3C-5, the lateral attachment members 36 can extend from a bottom side 220 of the object 200 and attach to the bottom surface 140 of the exterior container 110. The attachment members 36 may extend from a position that does not interfere with the path of the support assembly 10 about the object 200. For example, where multiple lateral attachment members 36 are used, the various lateral attachment members 36 may be positioned on either side of a region of the support assembly 10 that overlaps itself.

According to some embodiments, additional attachment members and support members can be provided to further support the object 200. For example, additional lateral attachment members (not shown) can extend from the first section 50 near the top side 210 of the object 200 and extend to a top side of the exterior container 110. Yet other additional lateral attachment members (not shown) can be provided as extending from any portion of the support assembly 10 and attaching to any surface of the exterior container 11 o. As with the lateral attachment member 36, such additional lateral attachment members can provide columnar support for or suspension of the object 200 relative to the corresponding surface of the exterior container 110.

According to some embodiments, a single support assembly 10 is provided to support the object 200. According to some embodiments, more than one support assembly 10 can be provided. For example, a second support assembly (not shown) can be provided during or after application of a first support assembly 10. The second or other subsequent support assemblies can have ends that attach to surfaces of the exterior container 110 other than the surfaces to which the first support assembly 10 is attached. Alternatively, the second or other subsequent support assemblies can have ends that attach to the same surfaces of the exterior container 110 to which the first support assembly 10 is attached. The second or other subsequent support assemblies can wrap around the object 200 along a perimeter other than the perimeter along which the first support assembly 10 is wrapped. Alternatively, the second or other subsequent support assemblies can wrap around the object 200 along a perimeter parallel to the perimeter along which the first support assembly 10 is wrapped. For example, the various support assemblies can be wrapped about the same axis or different axes of the object 200. The distance of the object 200 from the bottom surface 140 can further be influenced by application of the lateral attachment members 36. Clearance between the object 200 and the various surfaces of the exterior container 110 can be symmetrical (i.e., evenly distributed) or asymmetrical based on a known or planned orientation of the exterior container 110.

The foregoing description is provided to enable a person skilled in the art to practice the various configurations described herein. While the subject technology has been particularly described with reference to the various figures and configurations, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these configurations will be readily apparent to those skilled in the art, and generic principles defined herein may be applied to other configurations. Thus, many changes and modifications may be made to the subject technology, by one having ordinary skill in the art, without departing from the scope of the subject technology.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

As used herein, the phrase "at least one of" preceding a series of items, with the term "and" or "or" to separate any of the items, modifies the list as a whole, rather than each member of the list (i.e., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments.

A reference to an element in the singular is not intended to mean "one and only one" unless specifically stated, but rather "one or more." Pronouns in the masculine (e.g., his) include the feminine and neuter gender (e.g., her and its) and vice versa. The term "some" refers to one or more. Underlined and/or italicized headings and subheadings are used for convenience only, do not limit the subject technology, and are not referred to in connection with the interpretation of the description of the subject technology. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

While certain aspects and embodiments of the subject technology have been described, these have been presented by way of example only, and are not intended to limit the scope of the subject technology. Indeed, the novel methods and systems described herein may be embodied in a variety of other forms without departing from the spirit thereof. The accompanying claims and their equivalents are intended to cover such forms or modifications as would fall within the scope and spirit of the subject technology.

What is claimed is:

1. An apparatus comprising:

a main body;

a neck portion protruding longitudinally from a first end of the main body;

one or more first attachment members having a first affixing means disposed thereon and protruding longitudinally from a second end of the main body, the second end being an opposite end of the main body from the first end;

a second attachment member having a second affixing means disposed thereon and provided on an opposite end of the neck portion from the main body; and an opening disposed on the second end of the main body, the opening being at least partially enclosed by the one or more first attachment members along a corresponding one or more edges of the opening, wherein, when the one or more first attachment members are affixed to a first side of a container with the first affixing means, an object is supported in suspension within the container by placing at least a portion of a bottom surface of the object over an upper surface of the main body, wrapping the neck portion around the object so that at least a portion of the neck portion lies substantially flush against a top surface of the object, extending the neck portion through the opening and under a bottom surface of the main body and affixing the second attachment member to a second side of the container with the second affixing means, the second side being disposed on an opposite end of the container from the side of the container.

2. The apparatus of claim 1, further comprising a third attachment member disposed along a bottom surface of the neck portion, the third attachment member having a third affixing means disposed thereon, wherein, when the neck portion is wrapped around the object, at least a portion of the third affixing means engages the top surface of the object.

3. The apparatus of claim 1, wherein the neck portion comprises a plurality of peaks and a corresponding plurality of troughs, wherein the plurality of peaks and the corresponding plurality of troughs are capable of engaging one or more edges of the opening to secure a configuration of the apparatus around the object.

4. The apparatus of claim 1, wherein the main body comprises a lateral attachment member disposed on a bottom surface of the main body and capable of being affixed to a bottom portion of the container.

5. The apparatus of claim 1, wherein the opening comprises a slot.

6. The apparatus of claim 1, wherein the main body comprises one or more apertures.

7. The apparatus of claim 1, wherein the affixing means disposed on the one or more first attachment members is disposed on a bottom surface of the one or more first attachment members.

8. A container comprising:

a plurality of sides enclosing a volume of space; and a support apparatus, the support apparatus comprising:

a main body;

a neck portion extending longitudinally from a first end of the main body;

a first attachment member affixed to a first interior-facing side surface of the plurality of sides of the container, wherein the first attachment member protrudes longitudinally from a second end of the main body;

a second attachment member disposed on an opposite end of the neck portion from the main body ; and an opening having one or more edges, wherein the one or more edges are at least partially enclosed by the first attachment member, wherein, an object is supported in suspension within the container by placing at least a portion of a bottom surface of the object over an upper surface of the main body, wrapping the neck portion around the object so that at least a portion of the neck portion lies substantially flush against a top surface of the object, extending the neck portion through the opening and under a bottom surface of the main body and attaching the second attachment member to a second side of the plurality of sides, the second side being disposed on an opposite end of the container from the first interior-facing side surface of the container.

9. The container of claim 8, further comprising a third attachment member disposed along a bottom surface of the neck portion, the third attachment member having a third affixing means disposed thereon, wherein, when the neck portion is wrapped around the object, at least a portion of the third affixing means engages the top surface of the object.

10. The container of claim 8, wherein the neck portion comprises a plurality of peaks and a corresponding plurality of troughs, wherein the plurality of peaks and the corresponding plurality of troughs are capable of engaging one or more edges of the opening to secure a configuration of the support apparatus around the object.

11. The container of claim 8 further comprising:

a lateral attachment member disposed on a bottom surface of the main body and capable of being affixed to a bottom portion of the container.

12. The container of claim 8, wherein the opening comprises a slot.

13. The container of claim 8, wherein the main body comprises one or more apertures.

14. The container of claim 8, wherein the first attachment member is affixed to the first interior-facing side surface via an affixing agent disposed over a bottom surface of the first attachment member.

* * * * *